US007175383B2

(12) United States Patent
Stones et al.

(10) Patent No.: US 7,175,383 B2
(45) Date of Patent: Feb. 13, 2007

(54) REGENERATIVE FLUID PUMP AND STATOR FOR THE SAME

(75) Inventors: Ian David Stones, Burgess Hill (GB); Ingo Graham, Hove (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 10/516,832

(22) PCT Filed: Jul. 4, 2003

(86) PCT No.: PCT/GB03/02907

§ 371 (c)(1),
(2), (4) Date: Sep. 22, 2005

(87) PCT Pub. No.: WO2004/005722

PCT Pub. Date: Jan. 15, 2004

(65) Prior Publication Data

US 2006/0034676 A1 Feb. 16, 2006

(30) Foreign Application Priority Data

Jul. 5, 2002 (GB) ..... 0215709.7

(51) Int. Cl.
*F04D 1/08* (2006.01)

(52) U.S. Cl. ..... 415/55.4; 415/55.7

(58) Field of Classification Search ..... 415/55.1, 415/55.2, 55.3, 55.4, 55.5, 55.6, 55.7; 417/423.3
See application file for complete search history.

(56) References Cited

U.S. PATENT DOCUMENTS 3,917,431 A 11/1975 Rose
4,678,395 A 7/1987 Schweinfurter
5,498,125 A * 3/1996 Hablanian ..... 415/55.1
5,848,873 A 12/1998 Schofield
6,162,012 A * 12/2000 Tuckey et al. ..... 415/55.1

FOREIGN PATENT DOCUMENTS

| | | |
|---|---|---|
| EP | 0 770 781 A1 | 5/1997 |
| GB | 2 253 246 A | 9/1992 |
| JP | 090126179 A | 5/1997 |

OTHER PUBLICATIONS

Patent Abstracts of Japan, vol. 1995, No. 08, Sep. 29, 1995 & JP 07 127595 A (Nippon Soken Inc), May 16, 1995, abstract; figure 9.
United Kingdom Search Report of Application No. GB 0215709.7 Date of search: Jan. 31, 2003.
International Search Report of International Application No. PCT/GB03/02907; Date of mailing of the International Search Report: Oct. 13, 2003.

* cited by examiner

*Primary Examiner*—Richard A. Edgar
(74) *Attorney, Agent, or Firm*—Ira Lee Zebrak; Mary K. Nicholes

(57) ABSTRACT

A regenerative fluid pump (10) comprises a rotor having rotor blades for compressing fluid on two fluid flow paths, the first of which extends between a first pump inlet (12*a*) and a first pump outlet (14*a*), and a second of which extends between second pump inlet (12*b*) and a second pump outlet (14*b*). The pump comprises a stator comprising a plurality of concentric channels (16), each of which comprises: a pumping channel portion (18) along which said rotor blades move for compressing said fluid between an inlet and an outlet of the pumping channel; and a stripper channel portion (20) (shown in broken lines) which allows movement of said rotor blades from said outlet to said inlet of the pumping channel portion. Each concentric channel (16) comprises two pumping channel portions (18) and two stripper channel portions (20).

4 Claims, 2 Drawing Sheets

REGENERATIVE FLUID PUMP AND STATOR FOR THE SAME

The present invention relates to a regenerative fluid pump.

A regenerative fluid pump known hereto is shown schematically in FIG. 3. The prior art pump 100 is a radial regenerative fluid pump which compresses fluid on a single fluid flow path extending between an inlet 102 and an outlet 104 of the pump. The pump comprises a plurality of concentric circumferential channels 105 (represented by concentric circles in FIG. 3). The channels comprise respective pumping channel portions 106 along which fluid compression takes place and which together form part of the fluid flow path. The channels further comprise respective stripper channel portions 108 (shown in broken lines) which allow the passage of the pump's rotor blades from the outlets of respective pumping channel portions 106 to the inlets thereof.

In operation, fluid enters the pump inlet 102 and is compressed by the rotor blades in the radially outermost, or first, pumping channel portion 106*a*. At the outlet of the first pumping channel portion, fluid is diverted by a diversion channel 110 (shown by arrows in FIG. 3) to the inlet of a radially inner, or second, pumping channel portion 106*b*. At this time, rotor blades having passed along the first pumping channel 106*a* move into the radially outermost, or first, stripper channel portion 108*a* and back to the inlet of the first pumping channel 106*a*. Although most fluid is diverted radially inwardly by the diversion channel there is some seepage through the stripper channel portion due to the action of the rotor blades and the pressure gradient from the inlet to the outlet of the stripper channel portion. The stripper channel portion is made so that there are small running clearances between the walls of the stripper channels and rotor blades passing therethrough.

Fluid continues along the fluid flow path in the same manner as described above until it reaches the pump outlet 104 and for brevity this further operation will not be described.

It is desirable in certain circumstances to increase the pumping capacity of the regenerative pump 100 described above. FIG. 4 is a schematic view of a further prior art regenerative fluid pump 200 in which pumping capacity has been increased. Both pumps 100 and 200 are four stage pumps but unlike pump 100, pump 200 has two fluid flow paths between two pump inlets 202*a* and 202*b* and one pump outlet 204. The pump inlets 202*a* and 202*b* allow fluid to enter the first pumping channel portion 206*a* and 206*b*, respectively, where compression by the rotor blades takes place. This constitutes the first pumping stage of the pump and as it will be appreciated, pumping capacity increased by the use of parallel pumping channel portions 206*a*, 206*b*. In operation, fluid is diverted from the outlets of both the first and the second pumping channel portions 206*a*, 206*b* to the inlet of the third pumping channel portion 206*c* by first and second diversion channels 210*a* and 210*b*, respectively. Fluid from both the first and the second pumping channels 206*a*, 206*b* is then compressed in the third pumping channel portion 206*c* which constitutes the second pumping stage of pump 200. Fluid continues to be compressed along the fluid flow path until it reaches the pump outlet 204, in the same manner as with pump 100 above. The arrangement of pump 200 allows the pumping capacity to be increased.

The problems with pump 200 are that the additional pumping channel portion requires the pump to be larger and more massive, requiring increased manufacturing. Power requirements also increase and performance characteristics deteriorate.

It is desirable to provide a regenerative fluid pump with increased capacity, without some or all of the above mentioned problems.

The present invention provides a regenerative fluid pump comprising a rotor having rotor blades, and a stator comprising a plurality of concentric channels which comprise pumping channel portions along which said rotor blades move for compressing fluid between respective inlets and respective outlets of the pumping channel portions and stripper channel portions for allowing said rotor blades to pass from said outlets to said inlets of the pumping channel portions, wherein at least one of said concentric channels comprises at least two pumping channel portions and at least two stripper channel portions.

The present invention also provides a stator for a regenerative fluid pump comprising a rotor having rotor blades, the stator comprising a plurality of concentric channels which comprise pumping channel portions along which said rotor blades move for compressing fluid between respective inlets and respective outlets of the pumping channel portions and stripper channel portions for allowing said rotor blades to pass from said outlets to said inlets of the pumping channel portions, wherein at least one of said concentric channels comprises at least two pumping channel portions and at least two stripper channel portions.

Other aspects of the invention are defined in the accompanying claims.

In order that the present invention may be well understood, an embodiment thereof, will now be described, with reference to the accompanying drawings, in which.

Figure 1:
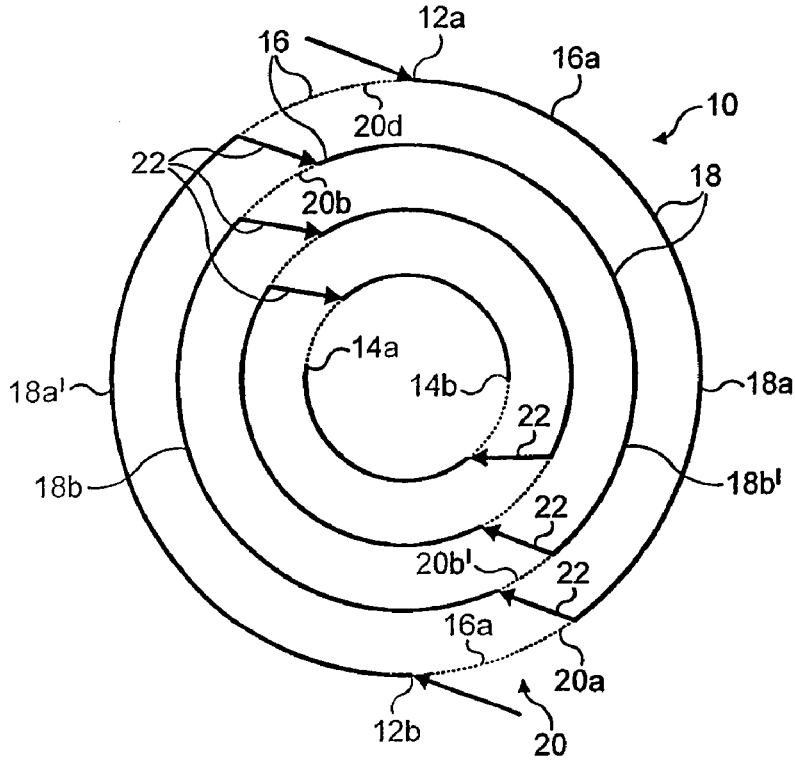
FIG. 1 is a schematic representation of a regenerative fluid pump embodying the present invention.
Figure 3:
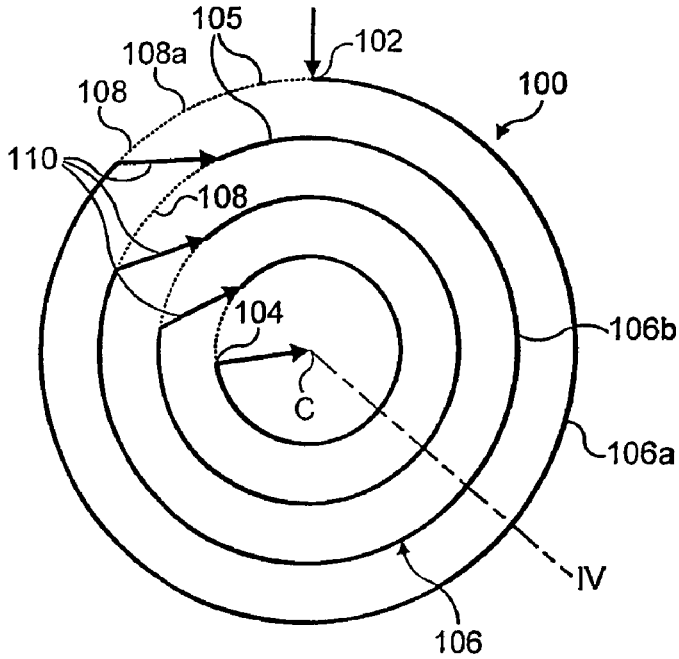
FIG. 3 PRIOR ART
FIG. 3 is a schematic view of a prior art regenerative fluid pump.
Figure 4:
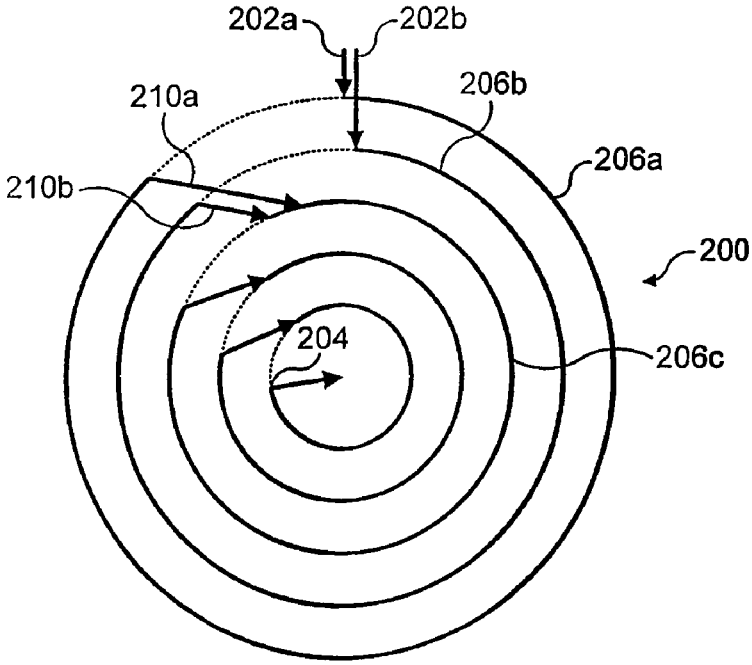
FIG. 4 PRIOR ART
FIG. 4 is a schematic view of another prior art regenerative fluid pump.

Referring to FIG. 1, a regenerative fluid pump 10 is shown which comprises four pumping stages although, more or less stages may be provided, as required. Pump 10 comprises a rotor (not shown) having rotor blades for compressing fluid on two fluid flow paths, the first of which extends between a first pump inlet 12*a* and a first pump outlet 14*a*, and a second of which extends between a second pump inlet 12*b* and a second pump outlet 14*b*. The pump comprises a stator comprising a plurality of concentric channels 16, each of which comprises: a pumping channel portion 18 along which said rotor blades move for compressing said fluid between an inlet and an outlet of the pumping channel; and a stripper channel portion 20 (shown in broken lines) which allows movement of said rotor blades from said outlet to said inlet of the pumping channel portion. Diversion channels 22 (indicated by arrows in FIG. 1) divert fluid between the pumping channel portions in the same way as the diversion channels described above in relation to FIG. 3.

Differently from the prior art, each concentric channel 16 comprises two pumping channel portions 18 and two stripper channel portions 20. Each channel 16 forms part of both fluid flow paths, although at diametrically opposed parts of the channel. Although each of the pumping channel portions 18 in respective concentric channels is shorter (extends over a reduced arc) as compared with the pump shown in FIG. 3, it has been found that most compression takes place over the latter portion of a pumping channel portion and therefore the reduction in length does not significantly affect compression ratio in the pumping channel portions. Accordingly, the capacity of the pump 10 is almost doubled as compared to the capacity of the pump 100 shown in FIG. 3. Reference is made to the Applicant's co-pending application (GB0215708.9) in which the effect of reducing the length of the pumping channel portion length is discussed in more detail.

In operation, fluid enters the first fluid flow path and the second fluid flow path at first pump inlet 12*a* and second pump inlet 12*b*, respectively. Fluid on the first fluid flow path is compressed by rotor blades passing along a first pumping channel portion 18*a* forming part of an outermost, or first, concentric channel 16*a*. At the outlet of the first pumping channel portion 18*a*, a diversion channel 22 diverts fluid to a radially inner, or second, concentric channel 16*b* and to an inlet of a first pumping channel portion 18*b* in channel 16*b*. Simultaneously, fluid on the second fluid flow path is compressed by rotor blades passing along a second pumping channel portion 18*a*' forming part of the outermost, or first, concentric channel 16*a*. At the outlet of the second pumping channel portion 18*a*', a diversion channel 22 diverts fluid to the radially inner, or second, concentric channel 16*b* and to an inlet of a second pumping channel portion 18*b*' in channel 16*b*. Respective stripper channel portions 20*a* and 20*a*' allow rotor blades to pass between the inlet and the outlet of pumping channel portions 18*a* and 18*a*'.

Fluid continues along both first fluid flow paths in the same way as described above with reference to the outermost, or first, concentric channel 16*a* until the fluid reaches pump outlets 14*a* and 14*b* where it is exhausted from the pump 10.

Figure 2:
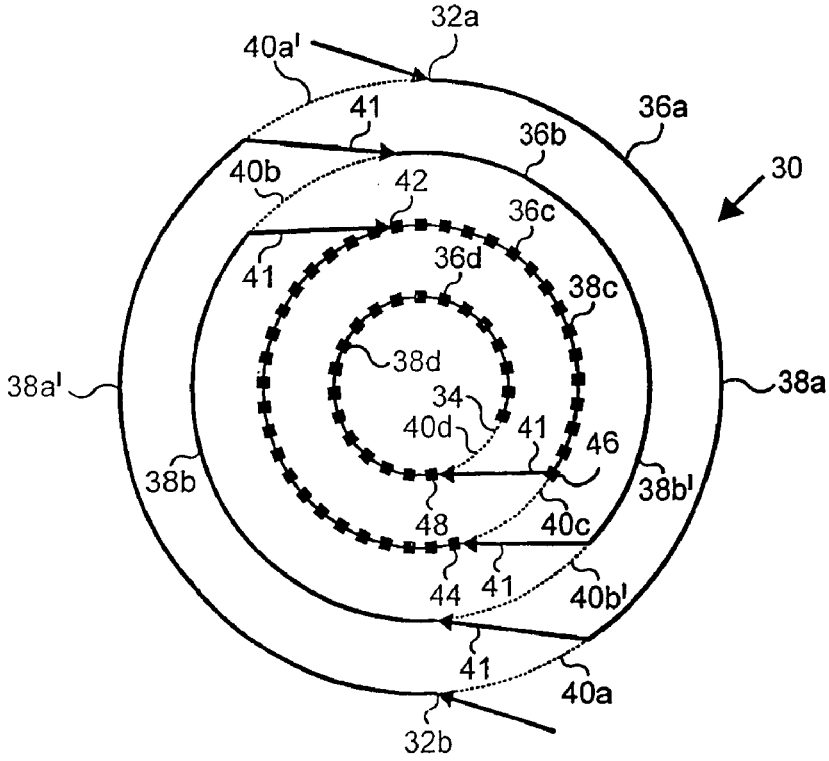
FIG. 2 is a schematic representation of another regenerative fluid pump embodying the present invention.

In pump 10, each concentric channel 16 comprises two pumping channel portions 18 and two stripper channel portions 20. However, it will be appreciated that increased pumping capacity will be achieved if only some or one concentric channel is provided with this parallel pumping arrangement. In FIG. 2, a pump 30 is shown in which the two radially outer concentric channels each have two pumping channel portions (shown in solid lines) and two stripper channel portions (shown in broken lines), whereas the two radially inner concentric channels have one pumping channel portion (shown in partially broken lines) and one stripper channel portion (shown in broken lines).

Fluid flows along a first fluid flow path extending from a first pump inlet 32*a* to a single pump outlet 34, and along a second fluid flow path extending from a second pump inlet 32*b* to the pump outlet 34. At the radially inner concentric channels, the first and the second fluid flow paths merge.

As with pump 10, fluid flowing on the first fluid flow path travels along respective first pumping channel portions 38*a*, 38*b* in first and second concentric channels 36*a*, 36*b*. At the outlet of the first pumping channel portion 38*b* in the second concentric channel 36*b*, fluid is diverted inwardly by a diversion channel 41 to the third concentric channel 36*c* and to a secondary inlet 42 in pumping channel portion 38*c*. Inlet 42 is situated approximately half way along the length of pumping channel portion 38*c*. Fluid flowing on the second fluid flow path travels along respective second pumping channel portions 38*a*', 38*b*+ in first and second concentric channels 36*a*, 36*b*. At the outlet of the second pumping channel portion 38*b*' in the second concentric channel 36*b*, fluid is diverted inwardly by a diversion channel 41 to the third, or radially inner, concentric channel 36*c* and to a primary inlet 44 in pumping channel portion 38*c*. Inlet 44 is situated at the start of pumping channel portion 38*c*. First and second fluid flow paths merge at secondary inlet 42. At outlet 46 of pumping channel portion 38*c*, fluid is diverted inwardly by a diversion channel 41 to fourth, or radially innermost, concentric channel 36*d* and to the inlet 48 of the fourth pumping channel portion 38*d* where the fluid is compressed over the final stage of the pump 30 and exhausted through pump outlet 34.

Stripper channel portions 40*c* and 40*d* allow the passage of rotor blades from the outlets to the inlets of respective pumping channel portions 38*c* and 38*d*.

Pump 30 provides increased pumping capacity as compared with prior art pump 100 but provides less capacity than pump 10. With the parallel arrangement of fluid flow paths described in relation to FIGS. 1 and 2, pumping capacity can readily be changed by changing the stator of a pump. This is because the rotor is the same and the rotor blades are the same size from pump to pump. For instance, if it is desired to increase the capacity of pump 100 shown in FIG. 3, the stator can be replaced by the stator of pump 10 or pump 30. This means that variations in pumping capacity can be achieved at relatively lower costs. It will also be appreciated that the pumps shown in FIGS. 1 and 2 achieve increased capacity without significant changes in pump size or mass, and without substantial increases in power requirements.

As shown in FIG. 1, two pumping channel portions are provided in each concentric channel. It is possible to provide more than two such pumping channel portions in each or one of the concentric channels, providing the required compression is achieved in each pumping channel portion.

FIG. 1 shows a radial regenerative fluid pump with increased pumping capacity. However, the present invention also relates to an axial regenerative fluid pump, in which the concentric channels are arranged axially as opposed to radially.

The invention claimed is:

1. A regenerative fluid pump comprising a rotor having rotor blades, and a stator comprising a plurality of concentric channels which comprise pumping channel portions along which said rotor blades move for compressing fluid between respective inlets and respective outlets of the pumping channel portions and stripper channel portions for allowing said rotor blades to pass from said outlets to said inlets of the pumping channel portions, wherein at least one of said concentric channels comprises at least two pumping channel portions and at least two stripper channel portions and wherein one or more radially inner said concentric channels each comprise a single said pumping channel portion and a single said stripper channel portion.

2. The regenerative fluid pump as claimed in claim 1, wherein one of said single pumping channel portions comprises two inlets.

3. A stator for a regenerative fluid pump comprising a rotor having rotor blades, the stator comprising a plurality of concentric channels which comprise pumping channel portions along which said rotor blades move for compressing fluid between respective inlets and respective outlets of the pumping channel portions and stripper channel portions for allowing said rotor blades to pass from said outlets to said inlets of the pumping channel portions, wherein at least one of said concentric channels comprises at least two pumping channel portions and at least two stripper channel portions and wherein one or more radially inner said concentric channels each comprise a single said pumping channel portion and a single said stripper channel portion.

4. The regenerative fluid pump as claimed in claim 3, wherein one of said single pumping channel portions comprises two inlets.

* * * * *